United States Patent [19]

Merz et al.

[11] 4,209,764

[45] Jun. 24, 1980

[54] RESISTOR MATERIAL, RESISTOR MADE THEREFROM AND METHOD OF MAKING THE SAME

[75] Inventors: Kenneth M. Merz, Gladwyne; Howard E. Shapiro, Philadelphia, both of Pa.

[73] Assignee: TRW, Inc., Cleveland, Ohio

[21] Appl. No.: 962,235

[22] Filed: Nov. 20, 1978

[51] Int. Cl.[2] ..... H01C 1/012

[52] U.S. Cl. ..... 338/308; 29/610 R; 252/512; 427/101

[58] Field of Search ..... 338/306–309; 252/512; 29/610; 427/101, 102, 126; 106/54

[56] References Cited

U.S. PATENT DOCUMENTS

| | | | |
|---|---|---|---|
| 3,394,087 | 7/1968 | Huang et al. | 252/512 |
| 4,053,866 | 10/1977 | Merz et al. | 338/309 |

OTHER PUBLICATIONS

Merz, et al., Proceedings, Electronics Components Conference, "Nitride-Metal Resistive Glazes", pp. 292–298, 1968.

Shapiro, et al., Twenty-Fifth Electronic Components Conference, "Refractory Metal Glazes for Thick Film Networks", pp. 331–336, May 12–14, 1975.

Buzan, et al., Twenty-Seventh Electronics Components Conference, "A Thick Film Base Metal Resistor and Compatible Hybrid System", pp. 339–347, May 16–18, 1977.

*Primary Examiner*—C. L. Albritton

*Attorney, Agent, or Firm*—Jacob Trachtman

[57] ABSTRACT

A vitreous enamel resistor material comprising a mixture of a vitreous glass frit and fine particles of tantalum. The vitreous enamel resistor material may also include fine particles selected from titanium, boron, tantalum oxide ($Ta_2O_5$), titanium oxide (TiO), barium oxide ($BaO_2$), zirconium dioxide ($ZrO_2$), tungsten trioxide ($WO_3$), tantalum nitride ($Ta_2N$), titanium nitride (TiN), molybdenum disilicide ($MoSi_2$), and magnesium silicate $MgSiO_3$). An electrical resistor is made from the resistor material by applying the material to a substrate and firing the coated substrate to a temperature at which the glass melts. Upon cooling, the substrate has on a surface thereof a film of glass having the tantalum particles and particles of the additive material, if used, embedded therein and dispersed therethroughout.

21 Claims, 1 Drawing Figure

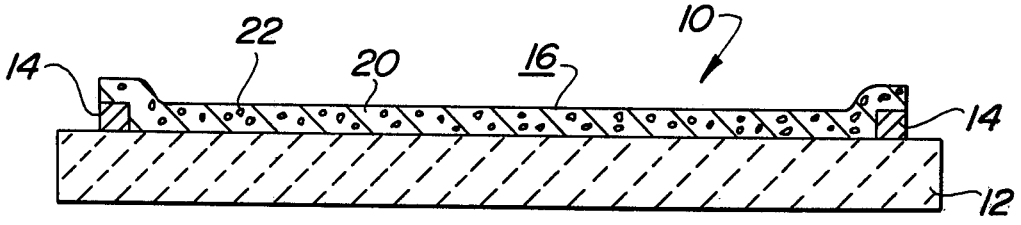
10
22
20
16
14
14
12

RESISTOR MATERIAL, RESISTOR MADE THEREFROM AND METHOD OF MAKING THE SAME

The present invention relates to a resistor material, resistors made from the material, and a method of making the same. More particularly, the present invention relates to a vitreous enamel resistor material which provides a resistor having a wide range of resistance values, and low temperature coefficient of resistance, and which is made from relatively inexpensive materials.

A type of electrical resistor material which has recently come into commercial use is a vitreous enamel resistor material which comprises a mixture of a glass frit and finely divided particles of an electrical conductive material. The vitreous enamel resistor material is coated on the surface of a substrate of an electrical insulating material, usually a ceramic, and fired to melt the glass frit. When cooled, there is provided a film of glass having the conductive particles dispersed therein.

Since there is a need for electrical resistors having a wide range of resistance values, it is desirable to have vitreous enamel resistor materials with respective properties which allow the making of resistors over a wide range of resistance values and also providing low resistance values. However, it is also desirable that such resistor materials have a low temperature coefficient of resistance so that the resistors are relatively stable with respect to changes in temperature. Heretofore, the resistor materials which had these characteristics generally have utilized the noble metals as the conductive particles and were therefore relatively expensive.

It is, therefore, an object of the present invention to provide a novel resistor material and resistor made therefrom.

It is another object of the present invention to provide a novel vitreous enamel resistor material and a resistor made therefrom.

It is still a further object of the present invention to provide a vitreous enamel resistor material which provides resistors having low resistance values as well as a wide range of resistance values, and relatively low temperature coefficients of resistance.

It is another object of the present invention to provide a vitreous enamel resistor material which provides resistors having low resistance values as well as a wide range of resistances, and relatively low temperature coefficients of resistance, and which material is relatively inexpensive and compatible with inexpensive copper and highly stable nickel terminations.

Other objects will appear hereinafter.

These objects are achieved by a resistor material comprising a mixture of a glass frit and a conductive phase provided by finely divided particles of tantalum. The conductive phase of the resistor material may also include finely divided particles selected from titanium, boron, tantalum oxide ($Ta_2O_5$), titanium oxide (TiO), barium oxide ($BaO_2$), zirconium dioxide ($ZrO_2$), tungsten trioxide ($WO_3$), tantalum nitride ($Ta_2N$), titanium nitride (TiN), molybdenum disilicide ($MoSi_2$), and magnesium silicate ($MgSiO_3$), in an amount of up to approximately 50% by weight of the tantalum particles. Although resistors have been made of tantalum nitride (TaN) and tantalum as described in Patent No. 3,394,087 dated July 23, 1968, and entitled Glass Bonded Compositions Containing Refractory Metal Nitrides And Refractory Metal, such resistors are not compatible with nickel thick film terminations required for providing stability under high firing conditions.

The invention accordingly comprises a composition of matter and the product formed therewith possessing the characteristics, properties, and the relation of components which are exemplified in the composition hereinafter described, and the scope of the invention is indicated in the claims.

For a fuller understanding of the nature and objects of the invention, reference should be had to the following detailed description taken in connection with the accompanying drawing in which:

The FIGURE is a sectional view of a portion of a resistor made with the resistor material of the present invention.

In general, the vitreous enamel resistor material of the present invention comprises a mixture of a vitreous glass frit and a conductive phase of fine particles of tantalum. The tantalum can be present in the resistor material in the amount of about 28% to about 77% by weight, and preferably in the amount of about 30% to about 73% by weight. The conductive phase of the resistor material may also include as additives titanium, boron, tantalum oxide ($Ta_2O_5$), titanium oxide (TiO), barium oxide ($BaO_2$), zirconium dioxide ($ZrO_2$), tungsten trioxide ($WO_3$), tantalum nitride ($Ta_2N$), titanium nitride (TiN), molybdenum disilicide ($MoSi_2$), or magnesium silicate ($MgSiO_3$), in an amount up to approximately 50% by weight of the tantalum particles. Each of these additives generally increases the sheet resistivity of the resistor material.

The glass frit used may be any of the well known compositions used for making vitreous enamel resistor compositions and which has a melting point below that of the tantalum. However, it has been found preferably to use a borosilicate frit, and particularly an alkaline earth borosilicate frit, such as barium, magnesium or calcium borosilicate frit. The preparation of such frits is well known and consists, for example, of melting together the constituents of the glass in the form of the oxides of the constituents, and pouring such molten composition into water to form the frit. The batch ingredients may, of course, be any compound that will yield the desired oxides under the usual conditions of frit production. For example, boric oxide will be obtained from boric acid, silicon dioxide will be produced from flint, barium oxide will be produced from barium carbonate, etc. The coarse frit is preferably milled in a ball mill with water to reduce the particle size of the frit and to obtain a frit of substantially uniform size.

The resistor material of the present invention is preferably made by mixing together the glass frit and the particles of tantalum in the appropriate proportions. Any additive material if used, is also added to the mixture. The mixing is preferably carried out by ball milling the ingredients in an organic medium such as butyl carbitol acetate.

To make a resistor with the resistor material of the present invention, the resistor material may be applied to a uniform thickness on the surface of a substrate to which terminations such as copper or nickel thick film terminations have been screened and fired. The substrate may be a body of any material which can withstand the firing temperature of the resistor material. The substrate is generally a body of an insulating material, such as ceramic, glass, porcelain, steatite, barium titanate, or alumina. The resistor material may be applied on the substrate by brushing, dipping, spraying, or screen stencil application. The substrate with the resistor material coating is then fired in a conventional furnace at a temperature at which the glass frit becomes molten. The resistor material is preferably fired in an inert atmosphere, such as argon, helium or nitrogen.

The particular firing temperature used depends on the melting temperature of the particular glass frit used. When the substrate and resistor material are cooled, the vitreous enamel hardens to bond the resistance material to the substrate.

As shown in the FIGURE of the drawing, a resistor of the present invention is generally designated as 10, and comprises a flat ceramic substrate 12 having on its surface a pair of spaced termination layers 14 of a termination material, and a layer of the resistor material 20 of the present invention which had been coated and fired thereon. The resistor material layer 20 comprises a film of glass 16 containing the finely divided particles 22 of tantalum and any additive used, embedded in and dispersed throughout the glass.

The following examples are given to illustrate certain preferred details of the invention, it being understood that the details of the examples are not to be taken as in any way limiting the invention thereto.

EXAMPLE I

Batches of a resistor material were made by mixing together powdered tantalum and a glass frit of the composition of by weight 42% barium oxide (BaO), 24% boron oxide ($B_2O_3$), and 34% silica ($SiO_2$). Tantalum particles manufactured by NRC, Inc. of Newton, Massachusetts, and designated as grade SGV-4 were used. Each batch contained a different amount of the tantalum as shown in Table I. Each of the batches was ball milled in butyl carbitol acetate.

After removing the liquid vehicle from each batch, the remaining mixture was blended with a screening vehicle which comprised by weight, 39% butyl methacrylate and 61% butyl carbitol acetate, except where otherwise indicated. The resultant resistor materials were screen stenciled onto ceramic substrates having on a surface thereof spaced terminations of copper glaze designated ESL 2310 of Electro Science Laboratories, Inc., Pennsauken, New Jersey, which were previously applied and fired at 950° C. After being dried at 150° C. for 10 to 15 minutes, the coated substrates were then fired in a conveyor furnace at 1000° C. over a ½ hour cycle in a nitrogen atmosphere. The resultant resistors were measured for resistance values and tested for temperature coefficients of resistance. The resistors were also subjected to a 175° C. No Load test. The results of these tests are shown in Table I, with each result being the average value obtained from the testing of a plurality of resistors of each batch.

TABLE I

| Conductive Phase (volume %) | 10 | 11 | 12 | 13 | 15 | 20 | 25 | 30 | 35 |
|---|---|---|---|---|---|---|---|---|---|
| Tantalum (weight %) | 36 | 38 | 41 | 43* | 47 | 56 | 63 | 68 | 73** |
| Resistance (ohms/square) | 3600 | 1560 | 2000 | 686 | 173 | 105 | 56 | 41 | 11 |
| Temperature coeff. of Resistance (PPM/°C.) | | | | | | | | | |
| +150° C. | −38 | −28 | −77 | 74 | 124 | 148 | 161 | 179 | 206 |
| −55° C. | −96 | −48 | −106 | 78 | 132 | 165 | 200 | 191 | 220 |
| 175° C. No Load (% change in Resistance) | | | | | | | | | |
| 24 hours | ±.07 | .04 | ±.01 | .04 | .05 | ∓.07 | ±.03 | .1 | .3 |
| 1000 hours | .4 | .4 | .6 | .2 | .3 | .4 | .6 | 1.3 | 2.6 |

*Screening vehicle of Example VIII was used.
**Screening vehicle of 50% Reusche 163C of L. Reusche & Co., Newark, New Jersey, and 50% butyl carbitol acetate, by weight, was used.

EXAMPLE II

Batches of resistor material were made in the same manner as described in EXAMPLE I, except that they contained the amounts of tantalum shown in Table II and tantalum particles designated grade SGQ-1 manufactured by NRC, Inc. were used. Resistors were made from the batches of resistor materials in the same manner as described in EXAMPLE I, and the results of testing the resistors are shown in Table II.

TABLE II

| Conductive Phase (volume %) | 7 | 8 | 9 | 10 | 30 | 40 |
|---|---|---|---|---|---|---|
| Tantalum (weight %) | 28 | 30 | 33 | 36 | 68* | 77* |
| Resistance (ohms/square) | 30,000 | 695 | 700 | 408 | 7.6 | 7.0 |
| Temperature coeff. of Resistance (PPM/°C.) | | | | | | |
| +150° C. | −1423 | 161 | 96 | 118 | 192 | 226 |
| −55° C. | −2696 | 180 | 101 | 128 | 225 | 205 |
| 175° C. No Load (% change in Resistance) | | | | | | |
| 24 hours | — | ±.2 | .5 | .05 | 1.3 | 11 |
| 360 hours | — | ±.5 | 1.9 | .2 | 3.8 | 27 |
| 1000 hours | — | ±.6 | 2.7 | .2 | 5.3 | 33 |

*Screening vehicle of Example VIII was used.

EXAMPLE III

Batches of resistor material were made in the same manner as described in EXAMPLE I, except that they contained the amounts of tantalum shown in Table III and the terminations on the substrates were of the nickel glaze designated CERMALLOY Ni 7328 of Bala Electronics Corp., West Conshohocken, Pennsylvania, applied and fired at 1000° C. Resistors were made from the batches of resistor materials in the same manner as described in EXAMPLE I, except that the first example of 10.5 volume percent conductive phase in Table III had its coated substrates fired at 1100° C. and the composition of its glass frit was by weight 44% silica ($SiO_2$), 29% boron oxide ($B_2O_3$), 14.4% aluminum oxide ($Al_2O_3$), 10.4% magnesium oxide (MgO), and 2.2% calcium oxide (CaO). The results of testing the resistors are shown in Table III.

TABLE III

| Conductive Phase (volume %) | 10.5* | 11 | 12 | 15 | 25 | 35 |
|---|---|---|---|---|---|---|
| Tantalum (weight %) | 37 | 38 | 41 | 47 | 63 | 73 |
| Resistance (ohms/square) | 5000 | 1780 | 1300 | 246 | 66 | 36 |
| Temperature coeff. of Resistance (PPM/°C.) | | | | | | |
| +150° C. | 142 | −56 | 38 | 88 | 179 | 180 |
| −55° C. | 160 | −80 | 38 | 101 | 207 | 208 |
| 175° C. No Load (% change in Resistance) | | | | | | |
| 24 hours | ±.02 | ±.01 | .0 | .01 | .01 | .1 |
| 1000 hours | −.07 | .05 | .03 | ∓.04 | ∓.03 | .2 |

*Glass composition of 2.2% calcium oxide (CaO), 10.4% magnesium oxide (MgO), 14.4% aluminum oxide ($Al_2O_3$), 29% boron oxide ($B_2O_3$), and 44% silica ($SiO_2$), by weight, was used.

EXAMPLE IV

Batches of resistor material were made in the same manner as described in EXAMPLE II, except that they contained the amounts of tantalum shown in Table IV and the terminations on the substrates were of nickel glaze designated CERMALLOY Ni 7328 of Bala Electronics Corporation, applied and fired at 1000° C. Resistors were made from the batches of resistor materials in the same manner as described in EXAMPLE I. The results of testing the resistors are shown in Table IV.

TABLE IV

| Conductive Phase (volume %) | 10 | 10 | 30 | 35 | 40 |
|---|---|---|---|---|---|
| Tantalum (weight %) | 36 | 36* | 68* | 73 | 77* |
| Resistance (ohms/square) | 430 | 505 | 7.4 | 12 | 7,1 |
| Temperature coeff. of Resistance (PPM/°C.) | | | | | |
| +150° C. | 115 | 109 | 181 | 191 | 195 |
| −55° C. | 128 | 121 | 244 | 249 | 236 |
| 175° C. No Load (% change in Resistance) | | | | | |
| 24 hours | ±.4 | ±.2 | ±.2 | ±.06 | .3 |
| 360 hours | ±.6 | ±.3 | ±.2 | — | .9 |
| 1000 hours | ∓.5 | ±.2 | ±.3 | .1 | .7 |

*Screening vehicle of Example VIII was used.

EXAMPLE V

Batches of resistor material were made in the same manner as described in EXAMPLE I, except that they contained the amount of tantalum shown in Table V. Resistors were made from the batches of resistor materials in the same manner as described in EXAMPLE I, except that the coated substrates were fired at 950° C. The results of testing the resistors are shown in Table V.

TABLE V

| Conductive Phase (volume %) | 10.5* | 15 | 25 | 30 | 35 |
|---|---|---|---|---|---|
| Tantalum (weight %) | 37 | 47 | 63 | 68 | 73 |
| Resistance (ohms/square) | 5000 | 266 | 74 | 51 | 47 |
| Temperature coeff. of Resistance (PPM/°C.) | | | | | |
| +150° C. | −19 | 99 | 166 | 170 | 176 |
| −55° C. | −21 | 111 | 200 | 191 | 187 |
| 175° C. No Load (% change in Resistance) | | | | | |
| 24 hours | ±.1 | .1 | ±.03 | .7 | 3.8 |
| 95 hours | ∓.1 | .2 | .04 | 1.6 | 7.7 |

*Glass composition of 50% barium oxide (BaO), 20% boron oxide ($B_2O_3$), and 30% silica ($SiO_2$), by weight, was used.

EXAMPLE VI

Batches of resistor material were made in the same manner as described in EXAMPLE I, except that they contained the amounts of tantalum shown in Table VI. Resistors were made from the batches of resistor material in the same manner as described in EXAMPLE I, except that the coated substrates were fired at 1025° C. The results of testing the resistors are shown in Table VI.

TABLE VI

| Conductive Phase (volume %) | 15 | 25 | 30 | 35 |
|---|---|---|---|---|
| Tantalum (weight %) | 47 | 63 | 68 | 73 |
| Resistance (ohms/square) | 163 | 62 | 34 | 34 |
| Temperature coeff. of Resistance (PPM/°C.) | | | | |
| +150° C. | 142 | 165 | 184 | 188 |
| −55° C. | 160 | 185 | 211 | 200 |
| 175° C. No Load (% change in Resistance) | | | | |
| 24 hours | .06 | ±.02 | .1 | .87 |
| 95 hours | .2 | .08 | .32 | 2.0 |
| 1000 hours | .2 | — | 2.0 | — |

EXAMPLE VII

Batches of resistor material were made in the same manner as described in EXAMPLE I, except that particles of titanium were mixed with the glass frit and the tantalum particles in the amounts shown in Table VII. Resistors were made with the resistance materials in the same manner as described in EXAMPLE I. The results of testing the resistors are shown in Table VII.

TABLE VII

| Conductive Phase (volume %) | 15 | 20 | 20 | 25 | 25 | 25 |
|---|---|---|---|---|---|---|
| Tantalum (weight %) | 45 | 52 | 50 | 58 | 57 | 54 |
| Titanium (weight %) | 1 | 2 | 2 | 2 | 3 | 5 |
| Resistance (ohms/square) | 188 | 60 | 60 | 65 | 74 | 83 |
| Temperature coeff. of Resistance PPM/°C.) | | | | | | |

TABLE VII-continued

| | | | | | | |
|---|---|---|---|---|---|---|
| +150° C. | 28 | 36 | −64 | 61 | −24 | −133 |
| −55° C. | 23 | 24 | −58 | 72 | −25 | −153 |
| 175° C. No Load (% change in Resistance) | | | | | | |
| 24 hours | .06 | −.04 | ±.05 | ±.02 | −.09 | ∓.07 |
| 1000 hours | 2.2 | .1 | ±.5 | .5 | .3 | .3 |

EXAMPLE VIII

Batches of resistor material were made in the same manner as described in EXAMPLE II, except that particles of titanium were mixed with the glass frit and the particles of tantalum in the amounts shown in Table VIII. Resistors were made from the batches of resistor material in the same manner as described in EXAMPLE II except that the screening vehicle was by weight 37% poly(αmethylstyrene), 30% Igepol CO 430, and 33% Amsco HSB. The results of testing the resistors are shown in Table VIII.

TABLE VIII

| | | | | | | | |
|---|---|---|---|---|---|---|---|
| Conductive Phase (volume %) | 30 | 30 | 30 | 30 | 31 | 33 | 35.5 |
| Tantalum (Weight %) | 68 | 65* | 61 | 61# | 57**# | 53.5**# | 50**# |
| Titanium (weight %) | 0 | 2 | 4 | 4 | 7 | 10.5 | 14 |
| Resistance (ohms/square) | 7.6 | 7.6 | 7.4 | 8.0 | 11.4 | 12.2 | 12.3 |
| Temperature coeff of Resistance (PPM/°C.) | | | | | | | |
| +150° C. | 192 | 116 | −31 | 48 | 139 | 121 | 88 |
| −55° C. | 225 | 157 | 11 | 71 | 159 | 142 | 115 |
| 175° C. No Load (% change in Resistance) | | | | | | | |
| 24 hours | 1.3 | ±.1 | −.3 | −.1 | .05 | .03 | .05 |
| 360 hours | 3.8 | .2 | — | — | .55 | .43 | .33 |
| 1000 hours | 5.3 | −.4 | .1 | ±.2 | — | — | — |

*Screening vehicle of 2% ethyl cellulose, and 98% Texahol ester alcohol, by weight, was used.
**Screening vehicle of 30% isobutyl methacrylate, and 70% Texanol ester alcohol, by weight, was used.
#Tantalum particles grade SGQ-2 of NCR, Inc. were used.

EXAMPLE IX

Batches of resistor material were made in the same manner as described in EXAMPLE VIII, except that particles of titanium were mixed with the glass frit and the tantalum particles in the amounts shown in Table IX. Resistors were made with the resistance materials in the same manner as described in EXAMPLE VIII, except that the terminations on the substrates were of nickel glaze designated CERMALLOY Ni 7328 of Bala Electronics Corporation, applied and fired at 1000° C. The results of testing the resistors are shown in Table IX.

TABLE IX

| | | | | | |
|---|---|---|---|---|---|
| Conductive Phase (volume %) | 30 | 35 | 35 | 35* | 35 |
| Tantalum (weight %) | 61 | 73 | 70 | 70 | 67 |
| Titanium (weight %) | 4 | 0 | 2 | 2 | 4 |
| Resistance (ohms/square) | 10.5 | 6.6 | 5.8 | 11.6 | 6.8 |
| Temperature coeff. of Resistance (PPM/°C.) | | | | | |
| +150° C. | −36 | 228 | 139 | 114 | 19 |
| −55° C. | ±12 | 279 | 194 | 147 | 25 |
| 175° C. No Load (% change in Resistance) | | | | | |
| 24 hours | ±.09 | .2 | −.03 | ±.04 | .09 |
| 360 hours | .1 | .2 | — | — | .19 |
| 1000 hours | −.1 | ±.07 | −.24 | .09 | ±.08 |

*Screening vehicle of Example I was used.

EXAMPLE X

Batches of a resistor material were made in the manner described in EXAMPLE I, except that each contained along with the glass frit and the tantalum particles, particles of tantalum oxide ($Ta_2O_5$), titanium oxide (TiO), or barium oxide ($BaO_2$). Resistors were made with the resistor materials in the same manner as described in EXAMPLE I. The results of testing the resistors are shown in Table X.

TABLE X

| | | | | |
|---|---|---|---|---|
| Conductive Phase (volume %) | 13 | 15 | 13 | 25 |
| Tantalum (weight %) | 37 | 37 | 38 | 58 |
| Tantalum Oxide (weight %) | 4 | 7 | — | — |
| Barium Oxide (weight %) | — | — | 2 | — |
| Titanium Oxide (weight %) | — | — | — | 2* |
| Resistance (ohms/square) | 2.1K | 1.6K | 1.3K | 117 |
| Temperature Coeff. of Resistance (PPM/°C.) | | | | |
| +150° C. | −55 | 187 | −187 | −49 |
| −55° C. | −75 | 208 | −275 | −11 |
| 175° C. No Load (% change in Resistance) | | | | |
| 24 hours | .09 | 1.0 | ±.05 | −.4 |
| 360 hours | .4 | 2.8 | .3 | — |
| 1000 hours | .6 | 4.1 | .5 | .2 |

*Product of reaction between equal molar quantities of $TiO_2$ and Ti heated for 3 hours in argon at 1200° C.

EXAMPLE XI

Batches of resistor material were made in the same manner as described in EXAMPLE I, except that particles of boron were included with the glass frit and the tantalum particles in the amount shown in Table XI. Resistors were made from the resistor materials in the manner described in EXAMPLE I. The results of testing the resistors are shown in Table XI.

TABLE XI

| | | | |
|---|---|---|---|
| Conductive Phase (volume %) | 12 | 13 | 15 |
| Tantalum (weight %) | 38 | 39 | 39 |
| Boron (weight %) | 0.5 | 1 | 2 |

TABLE XI-continued

| | | | |
|---|---|---|---|
| Resistance (ohms/square) | 785 | 3K | 1.2K |
| Temperature coeff. of Resistance (PPM/°C.) | | | |
| +150° C. | 70 | −29 | 42 |
| −55° C. | 72 | −44 | 37 |
| 175° C. No Load (% change in Resistance) | | | |
| 24 hours | .07 | .05 | .2 |
| 360 hours | — | .3 | — |
| 1000 hours | .3 | .4 | .9 |

TABLE XII-continued

| | | | |
|---|---|---|---|
| Resistance (ohms/square) | 480 | 940 | 2900 |
| Temperature coeff. of Resistance (PPM/°C.) | | | |
| +150° C. | 57 | 16 | −57 |
| −55° C. | 57 | 14 | −62 |
| 175° C. No Load (% change in Resistance) | | | |
| 24 hours | .06 | ±.06 | .05 |
| 360 hours | — | .6 | .3 |

EXAMPLE XII

Batches of resistor material were made in the same manner as described in EXAMPLE I, except that particles of tantalum nitride ($Ta_2N$) were included with the glass frit and the particles of tantalum in the amount shown in Table XII and the screening vehicle was, by weight, 20% butyl methacrylate, 30% butyl carbitol acetate, 1% ethyl cellulose and 49% Texanol ester alcohol. Resistors were made from the resistor materials in the manner described in EXAMPLE I. The results of testing the resistors are shown in Table XII.

TABLE XII

| | | | |
|---|---|---|---|
| Conductive Phase (volume %) | 11 | 11 | 11 |
| Tantalum (weight %) | 38 | 36 | 33 |
| Tantalum Nitride (weight %) | 0 | 3 | 6 |

EXAMPLE XIII

Batches of resistor material were made in the same manner as described in EXAMPLE I, except that particles of titanium nitride (TiN) were mixed with the glass frit and the tantalum particles in the amounts shown in Table XIII. Resistors were made with the resistance materials in the same manner as described in EXAMPLE I. The results of testing the resistors are shown in Table XIII.

TABLE XIII

| | | | | | | | | | |
|---|---|---|---|---|---|---|---|---|---|
| Conductive Phase (volume %) | 12 | 15 | 15 | 15 | 15 | 20 | 20 | 20 | 20 |
| Tantalum (weight %) | 41 | 40 | 40* | 42 | 42* | 44 | 48 | 52 | 56 |
| Titanium Nitride (weight %) | 0 | 3 | 3 | 3 | 3 | 6 | 4 | 2 | 0 |
| Resistance (ohms/square) | 2140 | 1860 | 1870 | 605 | 585 | 213 | 150 | 66 | 105 |
| Temperature coeff. of Resistance (PPM/°C.) | | | | | | | | | |
| +150° C. | ∓27 | −154 | −112 | 73 | 73 | 70 | 110 | 132 | 148 |
| −55° C. | ∓37 | −175 | −124 | 78 | 80 | 86 | 116 | 151 | 165 |
| 175° C. No Load (% change in Resistance) | | | | | | | | | |
| 24 hours | ∓.2 | ±.03 | .03 | ±.03 | −.01 | .1 | .0 | ∓.03 | ∓.07 |
| 360 hours | ±.3 | — | .02 | .3 | ±.01 | .6 | .2 | .2 | ±.2 |
| 1000 hours | ±.4 | .4 | .03 | .3 | .01 | 1.0 | .4 | .4 | .4 |

*Nickel terminations of Example III were used.

EXAMPLE XIV

Batches of resistor material were made in the same manner as described in EXAMPLE I, except that particles of molybdenum disilicide ($MoSi_2$), zirconium dioxide ($ZrO_2$), magnesium silicate ($MgSiO_3$) or tungsten trioxide ($WO_3$) were mixed with the glass frit and the tantalum particles in the amounts shown in Table XIV. Resistors were made with the resistance materials in the same manner as described in EXAMPLE I. The results of testing the resistors are shown in Table XIV.

TABLE XIV

| | | | | | | | | |
|---|---|---|---|---|---|---|---|---|
| Conductive Phase (volume %) | 11 | 22 | 13 | 13 | 20 | 21 | 25 | 25 |
| Tantalum (weight %) | 38 | 39 | 38 | 38 | 34 | 31 | 38 | 63 |
| Molybdenum Disilicide (weight %) | — | — | — | — | 13 | 16 | 16 | — |
| Zirconium Dioxide (weight %) | — | 12 | — | — | — | — | — | — |
| Magnesium Silicate (weight %) | — | — | 1.4 | — | — | — | — | — |
| Tungsten | | | | | | | | |

TABLE XIV-continued

| | | | | | | | | |
|---|---|---|---|---|---|---|---|---|
| Trioxide (weight %) | — | — | — | 3 | — | — | — | — |
| Resistance (ohms/square) | 1560 | 6000 | 820 | 260 | 252 | 213 | 82 | 72 |
| temperature Coeff. of Resistance (PPM/°C.) | | | | | | | | |
| +150° C. | −28 | −182 | 69 | 101 | 130 | 58 | 199 | 163 |
| −55° C. | −48 | −262 | 68 | 97 | 140 | 67 | 228 | 158 |
| 175° C. No Load (% change in Resistance) | | | | | | | | |
| 24 hours | .04 | .1 | — | — | .02 | .03 | −.06 | ±.05 |
| 360 hours | — | .5 | — | — | .07 | — | ±.07 | .3 |
| 1000 hours | .4 | .8 | — | — | .1 | .1 | .2 | .4 |

From the above Examples, there can be seen the effects on the electrical characteristics of the resistor of the present invention of variations in the composition of the resistor material and the method of making the resistor. Examples I, II, III and IV show the effects of varying the ratio of the conductive phase of tantalum and the glass frit. Examples I, V and VI show the effects of varying the firing temperature. Examples VII, VIII and IX show the effects of adding titanium to the conductive phase, while Example X shows the effect of adding tantalum oxide, titanium oxide or barium oxide to the conductive phase. The effects of adding boron or tantalum nitride ($Ta_2N$) to the conductive phase are illustrated by Examples XI and XII, while Examples XIII and XIV show the effects of adding to the conductive phase titanium nitride, molybdenum disilicide, zirconium dioxide, magnesium silicate, or tungsten trioxide. All of the Examples show the relatively high stability provided by the resistors for copper and nickel terminations. The stability of the resistor is also shown by the temperature coefficient of resistance provided within ±300 parts per million per °C., and the temperature coefficients of resistance provided within approximately ±200 parts per million per °C. for tantalum particles with certain additive particles. Change in resistance (ΔR) under no load testing for up to 1000 hours at 175° C. were as low as 0.01% and less than 1% for most resistor examples. The tables also show the wide range of resistivities and low resistivities provided by the invention ranging from about 6 ohms/square to 5000 ohms/square while still providing high stability. The resistors of the invention, thus, can be made of inexpensive material for providing varying resistivites with high temperature stability, while also permitting their termination by inexpensive materials of copper and nickel.

It will thus be seen that the objects set forth above, among those made apparent from the preceding description, are efficiently obtained, and since certain changes may be made without departing from the scope of the invention, it is intended that all matter contained in the above description shall be interpreted as illustrative and not in a limiting sense.

What is claimed is:

1. A resistor material comprising a mixture of a glass frit, particles of tantalum, and additive particles, said additive particles being present in up to approximately 50% by weight of the tantalum particles and selected from the group consisting of titanium, boron, tantalum oxide ($Ta_2O_5$), titanium oxide (TiO), barium oxide ($BaO_2$), zirconium dioxide ($ZrO_2$), tungsten trioxide ($WO_3$), tantalum nitride ($Ta_2N$), titanium nitride (TiN), molybdenum disilicide ($MoSi_2$), and magnesium silicate ($MgSiO_3$).

2. A resistor material in accordance with claim 1 in which the tantalum particles are present in the amount of about 28% to about 77% by weight.

3. A resistor material in accordance with claim 4 in which the tantalum is present in the amount of about 30% to about 73% by weight.

4. An electrical resistor having a temperature coefficient of resistance which is relatively stable as a function of resistivity comprising a ceramic substrate and a resistor material on a surface of said substrate, said resistor material comprising a film of glass having conductive particles consisting essentially of tantalum metal embedded in and dispersed throughout the glass.

5. An electrical resistor in accordance with claim 4 in which the resistor material contains about 28% to about 77% by weight of the tantalum.

6. An electrical resistor in accordance with claim 4 in which the resistor material contains about 30% to about 73% by weight of the tantalum.

7. An electrical resistor comprising a ceramic substrate and a resistor material on a surface of said substrate, said resistor material comprising a film of glass and particles of tantalum and additive particles embedded in and dispersed throughout the glass film, said additive particles being present in up to approximately 50% by weight of the tantalum particles and selected from the group consisting of titanium, boron, tantalum oxide ($Ta_2O_5$), titanium oxide (TiO), barium oxide ($BaO_2$), zirconium dioxide ($ZrO_2$), tungsten trioxide ($WO_3$), tantalum nitride ($Ta_2N$), titanium nitride (TiN), molybdenum disilicide ($MoSi_2$), and magnesium silicate ($MgSiO_3$).

8. An electrical resistor in accordance with claim 7 in which the resistor material contains about 28% to about 77% by weight of the tantalum.

9. An electrical resistor in accordance with claim 7 in which the resistor material contains about 30% to about 73% by weight of the tantalum.

10. A method of making an electrical resistor comprising the steps of mixing together a glass frit and particles consisting essentially of tantalum metal, coating the mixture onto the surface of a substrate of an electrical insulating material, firing said coated substrate in a substantially inert atmosphere at a temperature for providing a resistor having a temperature coefficient of resistance which is relatively stable as a function of resistivity and at which the glass frit melts, and then cooling said coated substrate to form the resistor.

11. The method in accordance with claim 10 in which the mixture contains about 28% to about 77% by weight of tantalum.

12. The method in accordance with claim 10 in which the mixture contains about 30% to about 73% by weight of tantalum.

13. A method of making an electrical resistor comprising the steps of mixing together a glass frit, and particles of tantalum, and particles of an additive material selected from the group consisting of titanium, boron, tantalum oxide ($Ta_2O_5$), titanium oxide (TiO), barium oxide ($BaO_2$), zirconium dioxide ($ZrO_2$), tungsten trioxide ($WO_3$), tantalum nitride ($Ta_2N$), titanium nitride (TiN), molybdenum disilicide (MoSihd 2), and magnesium silicate ($MgSiO_3$), the additive particles being present in up to approximately 50% by weight of the tantalum particles, coating the mixture onto the surface of a substrate of an electrical insulating material, firing said coated substrate in a substantially inert atmosphere at a temperature at which the glass frit melts, and then cooling said coated substrate.

14. The method in accordance with claim 13 in which the tantalum particles are present in the amount of about 28% to about 77% by weight.

15. The method in accordance with claim 13 in which the tantalum particles are present in the amount of about 30% to about 73% by weight.

16. An electrical resistor made by the steps of mixing together a glass frit and particles consisting essentially of tantalum metal, coating the mixture onto the surface of a substrate of an electrical insulating material, firing said coated substrate in a substantially inert atmosphere at a temperature for providing a resistor having a temperature coefficient of resistance which is relatively stable as a function of resistivity and at which the glass frit melts, and then cooling said coated substrate to form the resistor.

17. An electrical resistor made in accordance with claim 16 in which the mixture contains about 28% to about 77% by weight of tantalum.

18. An electrical resistor made in accordance with claim 16 in which the mixture contains about 30% to about 73% by weight of tantalum.

19. An electrical resistor made by the steps of mixing together a glass frit, and particles of tantalum, and particles of an additive material selected from the group consisting of titanium, boron, tantalum oxide ($Ta_2O_5$), titanium oxide (TiO), barium oxide ($BaO_2$), tantalum nitride ($Ta_2N$), titanium nitride (TiN), zirconium dioxide ($ZrO_2$), tungsten trioxide ($WO_3$), molybdenum disilicide ($MoSi_2$), and magnesium silicate ($MgSiO_3$), the additive particles being present in up to approximately 50% by weight of the tantalum particles, coating the mixture onto the surface of a substrate of an electrical insulating material, firing said coated substrate in an inert atmosphere at a temperature at which the glass frit melts, and then cooling said coated substrate.

20. An electrical resistor made in accordance with claim 19 in which the tantalum particles are present in the amount of about 28% to about 77% by weight.

21. An electrical resistor made in accordance with claim 19 in which the mixture contains about 30% to about 73% by weight of tantalum.

* * * * *